US007847246B2

(12) United States Patent
Brekenfeld

(10) Patent No.: US 7,847,246 B2
(45) Date of Patent: Dec. 7, 2010

(54) COLLISION-INDUCED DECOMPOSITION OF IONS IN RF ION TRAPS

(75) Inventor: Andreas Brekenfeld, Bremen (DE)

(73) Assignee: Bruker Daltonik, GmbH, Bremen (DE)

( * ) Notice: Subject to any disclaimer, the term of this patent is extended or adjusted under 35 U.S.C. 154(b) by 491 days.

(21) Appl. No.: 11/946,164

(22) Filed: Nov. 28, 2007

(65) Prior Publication Data

US 2008/0135747 A1 Jun. 12, 2008

(30) Foreign Application Priority Data

Dec. 4, 2006 (DE) ..... 10 2006 056 931

(51) Int. Cl.
*H01J 49/00* (2006.01)

(52) U.S. Cl. ..... 250/290; 250/281; 250/292

(58) Field of Classification Search ..... 250/281–300
See application file for complete search history.

(56) References Cited

U.S. PATENT DOCUMENTS 5,528,031 A 6/1996 Franzen
5,859,433 A * 1/1999 Franzen ..... 250/292
6,710,336 B2 * 3/2004 Wells ..... 250/292
6,949,743 B1 * 9/2005 Schwartz ..... 250/290
7,064,317 B2 6/2006 McLuckey et al.
2003/0071211 A1 * 4/2003 Kawato ..... 250/300
2006/0289738 A1 12/2006 Brkenfeld
2007/0176094 A1 * 8/2007 Wells ..... 250/292

FOREIGN PATENT DOCUMENTS

WO WO 2006/042187 A2 4/2006

* cited by examiner

*Primary Examiner*—Jack I Berman
*Assistant Examiner*—Brooke Purinton
(74) *Attorney, Agent, or Firm*—Law Offices of Paul E. Kudirka

(57) ABSTRACT

In an RF ion trap, analyte ions are fragmented by applying a moderately high RF storage voltage to the trap. The ions are then excited via dipolar excitation, and after a short time, the ions are forced into a resting state, again using dipolar excitation. The RF storage voltage is then rapidly reduced to a low value thereby making it possible to store small fragment ions produced by ergodic decompositions that occur subsequent to the reduction of the RF storage voltage.

10 Claims, 8 Drawing Sheets

COLLISION-INDUCED DECOMPOSITION OF IONS IN RF ION TRAPS

BACKGROUND

The invention relates to a method of generating fragment ions in collision processes and storing light fragment ions in RF ion traps, in which usually high RF storage voltages are set and fragment ions below a relatively high cut-off mass cannot be stored.

3D Paul traps comprise a hyperbolic ring electrode and two rotationally symmetric hyperbolic end cap electrodes. If an electric voltage is applied to the end caps, on the one hand, and to the ring electrode, on the other, an essentially quadrupolar field is generated in the interior. If the voltage is an RF voltage, the RF electric field created is able to store ions. For practical reasons, only one phase of this RF storage voltage is usually applied to the ring electrode, while the end cap electrodes are kept at ground potential. The RF storage voltage usually has a frequency of around one megahertz.

According to Hans Dehmelt, the RF storage field of a 3D ion trap can be envisaged as a three-dimensional pseudopotential well, with a potential minimum in the center, and the potential increasing parabolically in all spatial directions. The ions in the potential well are able to orbit in ellipses or oscillate through the center. The pseudopotential is a temporal integration over the square of the field intensity; the gradient of the pseudopotential continually drives the ions back to the center of the ion trap, irrespective of the polarity of their charge.

The ions are only stored if their mass is above a cut-off mass, however. The term "mass" here is always to be understood as the mass-to-charge ratio m/z, as is required in mass spectrometry, i.e. the physical mass m divided by the number z of (positive or negative) elementary charges. Ions below the cut-off mass are so light that during a half-phase of the RF storage voltage they can already be accelerated up to the opposing electrodes; it is not possible to store them because the pseudopotential does not exist in this case.

The remaining ions oscillate in the pseudopotential well in the ion trap, the oscillation frequencies being roughly inversely proportional to the mass of the ions at a given RF voltage. The oscillation frequencies are one characteristic of the mass. The oscillations of the ions can be resonantly excited very precisely and mass-selectively, for example. Very good approximation formulae are available for the relationship between oscillation frequency and mass.

If the ion trap is filled with a collision gas at a pressure between 1 and $10^{-2}$ Pascal, the oscillations of the ions in the potential well are damped within a short time in such a way that the ions collect in a small cloud in the minimum of the potential well. The size of the cloud is determined by the Coulomb repulsion between the ions themselves, on the one hand, and by the centrally-directed force of the pseudopotential, on the other. The time required for the damping is inversely proportional to the pressure of the collision gas. At a pressure of around $10^{-2}$ Pascal, the time up to the damping is a few milliseconds; the ion undergoes a few hundred collisions in this time.

3D ion traps can also be used as mass spectrometers by ejecting the stored ions selectively according to their mass and measuring them with secondary electron multipliers. Several different methods of ion ejection have been reported; they will not be discussed here further. Good commercial ion trap mass spectrometers have a mass range of up to a mass-to-charge ratio of m/z=3000 Daltons, and special scanning methods can also resolve the isotope patterns of quadruply charged ions at any mass. Ion trap mass spectrometers are among the most reasonably priced mass spectrometers; they are very widespread.

2D ion traps comprise rod-shaped electrode pairs arranged in parallel; they also go back to Wolfgang Paul. The phases of an RF voltage are applied across each of the electrode pairs. These ion traps are called two-dimensional because the pseudopotential increases from the longitudinal axis in only two spatial directions, and drives the ions back to the axis. In the longitudinal direction, special measures must be employed in order to keep the ions inside the 2D ion trap; these measures can be DC electric fields, or pseudopotentials produced by RF voltages across suitably shaped electrodes. If the ion trap is charged with damping gas, the ions can again be collected; in this case they collect in an elongated ion cloud in the axis of the ion trap.

A special form of 2D ion trap is the quadrupole ion trap, comprising four pole rods. These special 2D ion traps are often called "linear ion traps". Linear ion traps with four pole rods form a quadrupole field in the interior and can be used as mass analyzers in the same way as 3D ion traps. Here too, there are different scanning methods, for example those which eject the ions mass-selectively through slits in the pole rods or through diaphragms at the end of the rod systems. Commercial instruments with ejection through slits in the pole rods currently have a mass-to-charge ratio range of up to m/z=2000 Daltons.

All ion traps can also be coupled with other types of mass analyzer in order, for example, to achieve particularly high mass resolving power or to be able to measure ions of particularly high mass-to-charge ratios m/z. Couplings with ion cyclotron resonance analyzers, time-of-flight mass analyzers, magnetic sector field devices and Kingdon cells have been described. In these cases, the RF ion traps usually serve only to be available for the fragmentation of the ions, including the collision-induced decompositions which are particularly considered here.

We now turn to a field of application in which mass spectrometry plays an important role: proteomics. This frequently involves enzymatically breaking down the proteins to digest peptides, and analyzing these mass-spectrometrically. Fragmentation processes are very important here because they allow sequences of amino acids and modification structures to be identified.

Nowadays, two fundamentally different types of fragmentation are available in the different types of ion trap: "ergodic" fragmentation and "electron-induced" fragmentation.

All "electron induced" fragmentation methods consist in neutralizing an associated proton of a multiply charged peptide or protein ion by capture or transfer of an electron, whereupon a spontaneous rearrangement leads to cleavage of the amino acid chain. The cleavage does not occur at the peptide bonds, but at neighboring bonds, leading to so-called c- and z-fragment ions. Various forms of this type of fragmentation are now known: electron capture dissociation (ECD); electron transfer dissociation (ETD) and electron transfer by highly excited neutral particles (MAID="metastable atom induced dissociation"). Electron transfer dissociation (ETD), in particular, is carried out in ion traps.

"Ergodic" fragmentation of analyte ions refers here to a process in which a sufficiently large excess of internal energy in the analyte ions leads to fragmentation. This excess of energy can, for instance, be generated by a large number of collisions between the analyte ions and a collision gas, or by the absorption of a large number of photons from infrared radiation (IRMPD="infrared multi photon dissociation"), for example.

According to the "ergodic hypothesis" originally formulated by Boltzmann, in a closed system such as that of a complex molecular analyte ion, when a certain energy is present, then every state that can be achieved with this energy will in fact be achieved over the course of time. This ergodic hypothesis has since been proved mathematically, and is therefore no longer strictly a hypothesis. Since the fragmentation represents a possible state, that is the generation of two smaller particles of the analyte ion, the fragmentation will occur at some stage. The absorption of energy temporarily creates "metastable" analyte ions, which then at some stage decompose. The decomposition itself is characterized by a "half life", although this depends on the quantity of excess energy and cannot be determined with certainty.

The probability that a given bond will experience an ergodic cleavage depends on the binding energy. Only the weakest bonds in the analyte ion will be cleaved with a high probability. In proteins, the weakest bonds are those known as "peptide bonds" between the amino acids, leading to fragments in the b and y series, which occur partly as charged fragment ions and partly as neutral particles. Since the peptide bonds between different amino acids have somewhat different binding energies, some peptide bonds in the analyte ion are cleaved with a greater probability and others with a lower probability. As a result, not all the fragment ions created by cleaving peptide bonds have the same intensity in the fragment ion spectrum. The fluctuations in the intensities thus reflect the energies of the different types of peptide bond. Non-peptide bonds, on the other hand, are cleaved so rarely that the resulting fragments are not found in measurable quantities.

To generate fragment ions from the analyte ions by collision-induced decomposition in RF ion traps, it is necessary to first select an ion species to be fragmented into fragment ions and then measured. The analyte ions are usually present as a mixture: they may originate from several substances, all of which must be analyzed, or they may consist of ions of several charge levels, one of which is to be selected for the fragmentation. The fragment ions (of the first generation of fragmentations) are frequently termed "daughter ions", and the ions of the ion species selected from the analyte ions for fragmentation are frequently termed "parent ions". After selecting the parent ions, all other ions located in the ion trap are ejected from it using known methods so that only the parent ions remain.

Incidentally, the parent ions do not all have to have precisely the same mass; it is also possible to use ions of different mass which have the same molecular formula for their elemental composition but include different isotopic combinations. Indeed, the joint fragmentation of all the ions of such an isotope group is the predominantly used method because then the daughter ions also occur in isotope groups, and it easy to read off the charge state on the isotope groups.

The process of ejecting all ions not selected is frequently termed "isolation" of the parent ions. The basic principles of the ejection are largely known, and it can easily be conducted in all commercially available ion trap mass spectrometers. It is based, on the one hand, on using the lower mass limit to eject the ions which are lighter than the parent ions, and, on the other hand, on using mass-selective resonant excitation of the oscillations of the undesired heavier ions; the excitation used is so strong that the ions touch the electrodes and are thus discharged, or otherwise disappear from the ion trap. In 3D ion traps, the resonant excitation is brought about by an alternating voltage, applied across the two end cap electrodes and thus generates a dipole alternating field. In 2D ion traps, the dipolar excitation voltages can be applied across two opposing pole rods.

The remaining parent ions are damped in the collision gas and thus collect again in a small cloud in the center of the ion trap. They can now be fragmented. The usual type of fragmentation is collision-induced decomposition (CID). A relatively soft resonant excitation forces them to oscillate, leading to a large number of low-energy collisions with the collision gas. In many of these collisions, small portions of energy are transferred into the parent ions. The internal energy of the internal molecular oscillation systems increases until one of the weaker bonds within the molecular structure of the parent ion breaks open. A singly charged parent ion forms a daughter ion and a neutral particle; a doubly charged parent ion frequently (but not always) forms two singly charged daughter ions. Since the daughter ions are no longer resonantly excited because they have a different mass, and hence a different oscillation frequency, their oscillations are damped by the collision gas after the fragmentation, and the daughter ions collect in the center. They can then, for example, be measured as a daughter ion spectrum in the conventional way in a detector located outside the ion trap after being resonantly and selectively ejected in sequence according to their mass.

This type of collision-induced decomposition has disadvantages, the main one being that there are both heating and cooling collisions. The terms "heating" and "cooling" refer to the internal energy of the parent ions, not to the energy of the secular oscillations, for which the terms "excite" and "damp" are always used here. If the collisions are all low-energy, i.e. if parent ion and collision gas molecule collide very slowly with each other, the cooling collisions predominate: the internal energy of the parent ions is reduced by transferring energy to the collision gas molecule. The parent ion can only absorb energy in hard collisions of rapidly colliding partners. Since helium is usually used as the collision gas, the collision gas molecules cannot take up any internal energy at all. This transfer of energy into the interior of the parent ions requires the excitation of energy states of the internal oscillation systems, which, as is known from quantum theory, demands a minimum energy. Only hard collisions, i.e. collisions in which the collision partners have a high relative speed, result in the parent ions being heated.

The excitation for the fragmentation must therefore involve collisions which are sufficiently hard, i.e. minimum speeds of the parent ions produced by excitation of their secular oscillations. These hard collisions can only be achieved with a relatively high RF storage voltage because only then are the walls of the potential well steep and high enough to achieve rapid, wide oscillations. But, even in this case, special care must be exercised: the damping of the secular oscillations of the parent ions in the collision gas must always remain in equilibrium with the constant increase in amplitude caused by the dipolar excitation because, if it does not, the amplitudes of the secular oscillations increase until the parent ion leaves the ion trap. Since the damping brought about by collisions with the collision gas is a statistical process, the alternating voltage used to resonantly excite the secular oscillations must be carefully kept small to avoid losing large numbers of ions. Despite reduced average deflection, a high RF storage voltage has to be applied to achieve high collision speeds.

There is rule of thumb in the literature which states that the fragmentation can only be carried out when the RF storage voltage has at least a value which produces a lower mass threshold equivalent to a third of the mass-to-charge ratio of the parent ions. However, this does not allow small fragment ions with a mass-to-charge ratio below a third of the mass-to-charge ratio of the parent ions to be collected in the trap.

Again we turn to proteomics. As already mentioned, this field frequently involves enzymatically breaking down the proteins to digest peptides, and analyzing these mass-spectrometrically. If one begins with peptide ions, then often so-called internal fragments form in the collision cells; these internal fragments originate from two cleavages of the amino acid chain. So-called immonium ions, in particular, often result; these are charged single amino acids originating from somewhere in the chain. The measurement of such immonium ions has high informational value since they immediately signalize the presence of this amino acid in the peptide. It is frequently possible to read off the amino acid composition of the peptide from the immonium ions, even if it is not possible to thus determine the arrangement of the amino acids along the chain.

To also store very small fragment ions (particularly of the immonium ions) by collision-induced decomposition, special methods have recently been published which utilize the slow, metastable decomposition of the ions through the ergodic fragmentation process.

In U.S. Pat. No. 6,949,743 B1 (J. C. Schwartz) a method of collision-induced decomposition is proposed which uses a brief excitation of the analyte ions with a short pulse of resonant alternating excitation voltage at high RF storage voltage. The RF storage voltage is then decreased in order to lower the lower mass threshold and to allow light fragment ions to be collected.

In Patent DE 10 2005 025 497 B4 (A. Brekenfeld), too, the fragmentation is carried out for a brief period of between a few tenths of a millisecond and a few milliseconds at an RF storage voltage which is higher than normal. In the course of the subsequent damping of the secular oscillations by the collision gas, there is then a controlled changeover to a low RF storage voltage. This transition to low RF storage voltages must not occur rapidly because, if it does, the oscillating ions can escape from the well as the storage well becomes shallower. When the high RF storage voltage for the fragmentation is applied, it is possible to use either resonant excitation or deflection of the parent ions far out of the center by means of DC potentials across at least one of the electrodes; when these are switched off only the strongly restoring force of the RF storage voltage continues to act on the ions, so that the ions undergo powerful collisions with the collision gas. The subsequent low RF storage voltage allows the fragment ions, which also include very light daughter ions and granddaughter ions, to then collect in the center of the ion trap, and they can be measured in the normal way.

Heavy analyte ions in the mass range of m=2000 to 5000 Daltons and above represent a great difficulty for collision-induced decomposition. This is especially because they require much more internal energy to fragment ergodically in a reasonably short time. If there is a longer delay before fragmentation, the collision gas again causes cooling, i.e. there is a loss of internal energy so that no further ergodic fragmentation occurs at all. In addition, a great many highly charged fragment ions are produced, which make it difficult or even impossible to evaluate the fragment ion spectrum. One solution to this problem is to deprotonate the highly charged analyte ions before they are fragmented.

An interesting method of deprotonating highly charged pseudomolecules, which has basically been known for a long time, has recently been elucidated. The highly charged pseudomolecule ions of a substance, which are present with different charge levels, can be deprotonated at the same time in an RF ion trap, and this deprotonation process can be halted at a certain charge level so that all pseudomolecule ions with higher charge levels collect at this selected charge level in a partially deprotonated state. This requires that a gentle resonant excitation of the secular oscillations be created at the mass-to-charge ratio m/z of this charge level of the analyte ions by means of a dipole alternating voltage. The ions of this charge level, which are now oscillating in an excited state, are no longer able to take part in further reactions with deprotonating reactant anions, since deprotonation requires the partners involved to have a low relative speed. This method is described in U.S. Pat. No. 7,064,317 B2 (S. M. McLucky et al.).

Such a conversion of highly charged pseudomolecular ions of different charge levels into a predetermined charge level provides, at the same time, a high sensitivity because the analyte ions of all higher charge levels collect with a relatively high yield at the selected charge level during deprotonation. Yields of over 50 percent can be achieved. If the highly charged ions of several substances are present, it is thus also possible to select the analyte ions because the ions of the foreign substances are not collected, but are deprotonated to the bitter end, until they are neutralized, if the reaction time is long enough.

This type of partial deprotonation is therefore very useful in making highly charged heavy analyte ions available for a collision-induced decomposition in the first place.

SUMMARY

The basic idea of the invention is to excite the parent ions for the collision-induced decomposition at a moderately high to high RF storage voltage by means of electric fields in such a way that the amplitude of their oscillations rapidly attains the maximum possible in the ion trap, and also that, after an exposure time for collisions, these oscillations are again forced to rapidly decelerate to a halt by opposing electric fields so that the parent ions are in the resting state afterwards. The RF storage voltage can then suddenly be set to a low value so that also light fragment ions from subsequent ergodic decompositions are collected in the ion trap.

"Rapid" excitation is defined here as one where the maximum amplitude of oscillation is achieved after only a few oscillation cycles; in the limiting case in only one quarter of an oscillation cycle. The process of bringing the oscillating ions back to their resting state is termed "deceleration to a halt" here. A "rapid deceleration to a halt" means that the resting state is attained again in a few oscillation cycles; in the limiting case again in one quarter of an oscillation cycle. A "moderately high" RF storage voltage is one where the lower mass threshold is between one eighth and two fifths of the mass-to-charge ratio of the parent ions. In this range, the conventional collision-induced decomposition is carried out with an excitation-damping equilibrium, whose usual mass threshold is one third. The RF storage voltage is "high" if the mass threshold is above two fifths of the mass-to-charge ratio of the parent ions.

In the simplest case, the idea of the invention can be carried out with a non-resonant excitation of specific duration. If parent ions whose secular oscillation frequency is, for example, precisely 100 kilohertz when the RF storage voltage is set are excited with a dipole alternating voltage of 95 kilohertz, the ions begin to oscillate, form a beat antinode of defined amplitude after ten oscillations, and then reduce their amplitudes of oscillation again so that after 20 oscillations, i.e. after some 200 microseconds, they are again in the beat node in the resting state. If the alternating excitation voltage is now switched off, the parent ions remain at rest. The maximum amplitude in the beat antinode can be precisely predetermined by the height of the excitation voltage.

If a frequency which is further from the secular frequency of the ions is selected for an alternating excitation voltage, the maximum is achieved faster, but a higher excitation voltage is required for the same maximum amplitude of the beat antinode. At a frequency of 90 kilohertz the maximum of the beat antinode is attained after only five oscillations, and the beat node after only ten oscillations. This faster increase in the amplitude of the oscillation at the beginning is essentially favorable because fewer cooling collisions are experienced. The brief exposure time for hard collisions is a disadvantage, however.

The exposure time can be extended by switching off the alternating excitation voltage when the beat antinode is attained for a time n*T, where T is the period of the secular frequency of the parent ion, and n stands for an arbitrary positive integer. The parent ions then continue to oscillate with almost undiminished amplitude, only damped by the collision gas. This damping is not very great, however, because essentially only hard collisions are experienced, not elastic collisions, which have a greater damping effect. After a sufficiently long exposure time the oscillations can be decelerated to a halt by switching on the alternating excitation voltage in phase until the beat node, and hence the resting state, has been attained. The exposure time is limited by the slightly non-synchronous oscillation of the various ions of an isotope group; in general, this exposure must not last longer than around one millisecond.

Several other embodiments lead to very similar results: for example, a resonant excitation of defined form, an excitation with a superimposition of several non-resonant excitation frequencies, or excitation and deceleration to a halt by a single DC voltage pulse applied for the correct length of time in each case.

A dipole DC voltage can also be used to bring the parent ions out of the center of the ion trap and into a region in which they experience very hard collisions as a result of forced oscillations caused by the storage RF field. Here, again, it is possible to quickly return to the resting state.

Very heavy analyte ions introduced into the ion trap in a highly charged state can first be subjected to a charge reduction by deprotonation with the aid of negative ions to enable effective collision-induced decomposition. A particularly suitable method is to halt this deprotonation at a predetermined charge level whose ions are particularly suitable for collision-induced decomposition.

The various types of collision-induced decomposition not only provide different types of information but also have different detection sensitivities. In automated analytical methods, which are used when mass spectrometry and liquid chromatography are coupled, for example, it is therefore advisable to allow the type of collision-induced decomposition to be determined automatically by the mass, charge state and frequency of the analyte ions under analysis. Thus, depending on mass, charge state and frequency, one of the following processes is automatically carried out: conventional collision-induced decomposition by excitation-damping equilibrium; collision-induced decomposition by brief excitation with damping and reduction of the storage RF voltage; non-resonant excitation/deceleration to a halt; resonant excitation/deceleration to a halt; or pulsed excitation/deceleration to a halt. The latter methods entail a sudden reduction of the storage RF voltage. Moreover, depending on the mass, charge state and frequency, it is possible to automatically determine whether the collision-induced decomposition is preceded by a deprotonation and at what charge level this deprotonation is halted.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 9:
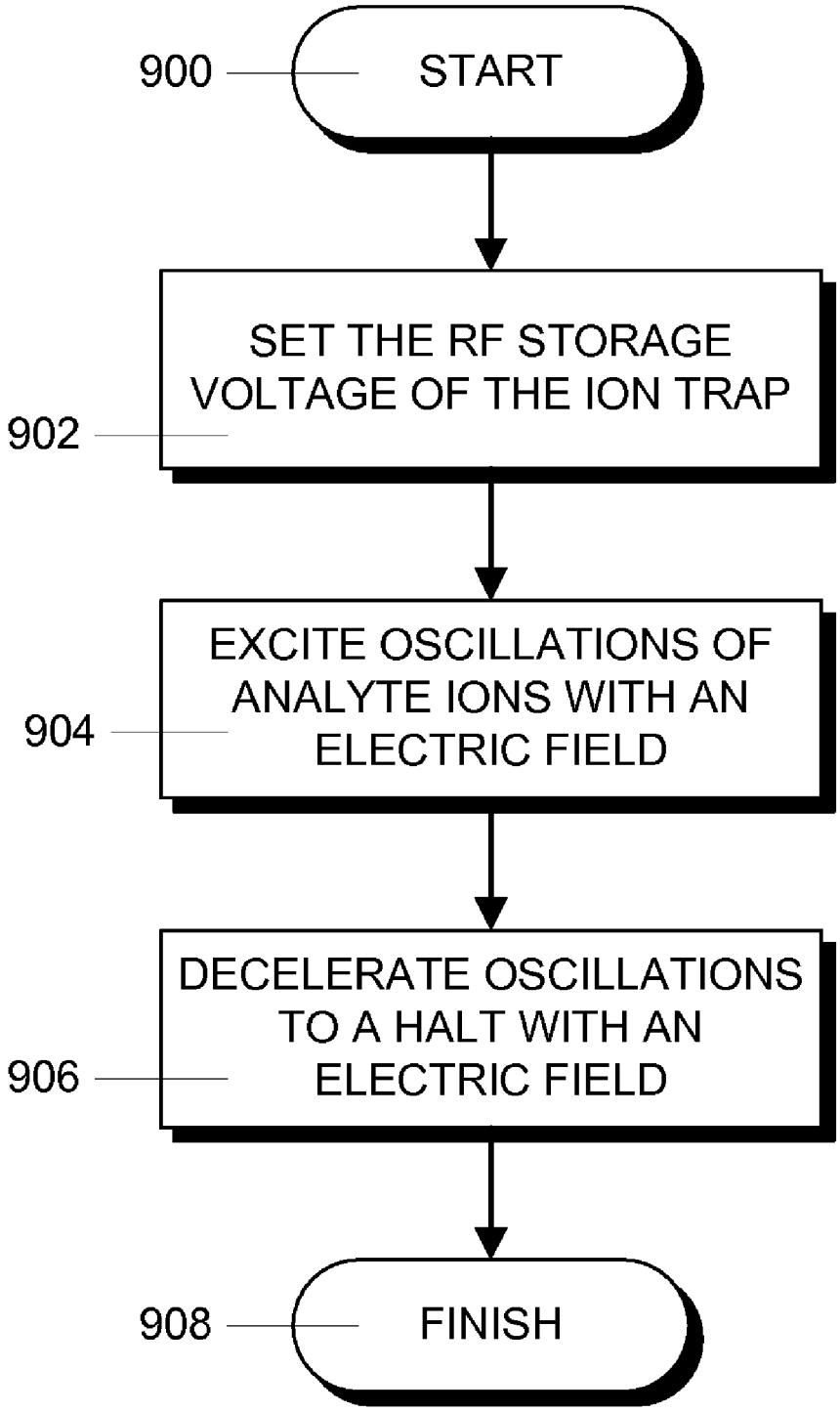
FIG. 9 is a flowchart showing the steps in an illustrative process for collision-induced decomposition in an RF ion trap according to the principles of the invention.

The method according to the principles of the invention is shown in FIG. 9. The illustrated process begins in step 900 and proceeds to step 902 where the RF storage voltage of the ion trap is set to a moderately high to a high value, for example, such that a lower mass threshold of the ion trap is greater than one eighth and less than one half of the mass-to-charge ratio of the analyte ions. Then, in step 904, oscillations of the analyte ions are excited by means of an electric field in order to produce hard collisions with the collision gas. Finally, in step 906, the oscillations are decelerated to a halt by means of an electric field in order to assemble the collisionally excited analyte ions in the center of the ion trap. The process then finishes in step 908.

Figure 1:
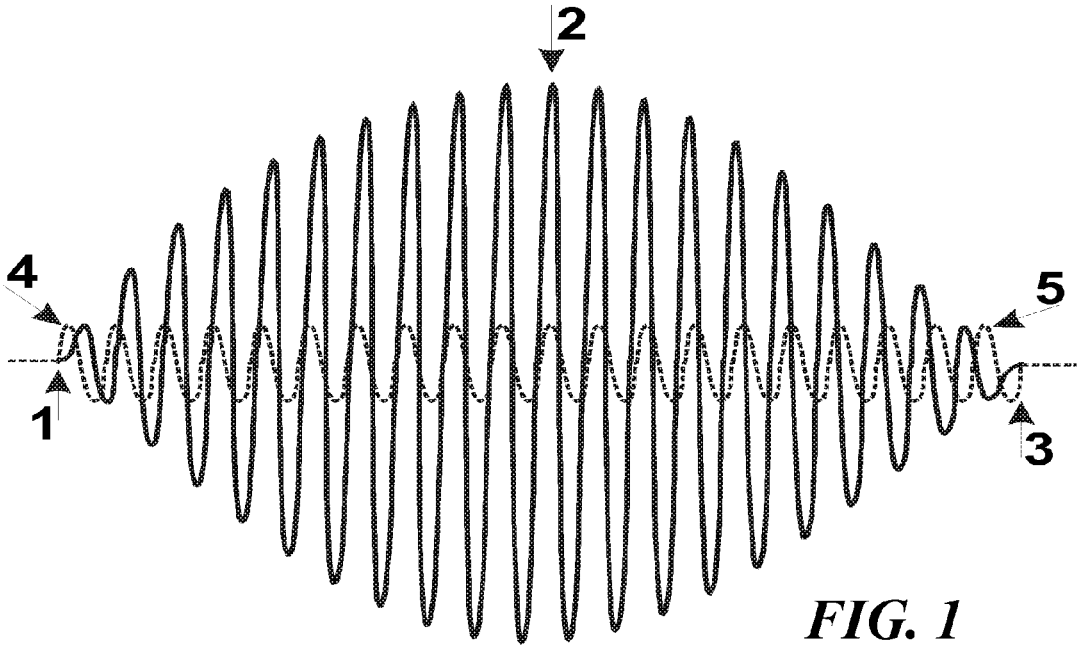
FIG. 1 illustrates a simple beat cycle of the secular oscillations of parent ions whose secular oscillation frequency is 100 kilohertz and which are non-resonantly excited with 95 kilohertz. (1) Beginning of the excitation, (2) beat antinode, (3) beat node with end of the excitation, where the ions are again in the resting state, (4) and (5) excitation voltage (dashed line). Any excitation or deceleration to a halt has maximum effect when the alternating excitation voltage and the ion oscillations are out of phase by 90°; when they are in phase, there is no acceleration or deceleration to a halt.

A particularly simple embodiment uses a simple beat shape to generate hard collisions, as shown in FIG. 1. A simple beat cycle of the secular oscillations of parent ions, whose secular oscillation frequency is 100 kilohertz, is generated here by a non-resonant excitation at a frequency of 95 kilohertz. Precisely ten oscillation cycles after the excitation begins (1), the beat antinode (2) is attained, and after a further ten cycles of oscillation the parent ions are again in the resting state of the beat node (3). The excitation voltage is switched off at this point. It can be clearly seen that, as is known, any excitation or deceleration to a halt has maximum effect when the alternating excitation voltage and the ion oscillations are out of phase by 90°; when they are in phase, there is no further acceleration or deceleration to a halt. The maximum amplitude can be precisely matched to the dimensions of the ion trap so that a high parent ion speed makes the collisions very hard but, despite this, no parent ions are lost in collisions with the electrodes.

Incidentally, in the beat antinode the ions oscillate with a frequency which does not correspond to the secular frequency of the freely oscillating ions. A Fourier analysis of the oscillation indicates that there is a superimposition of two frequencies: those of the excitation and those of the secular oscillation of freely oscillating ions.

FIG. 1 is only an approximation because the forced oscillations imposed by the RF storage voltage have been omitted in order to produce a simple graphic representation. These forced oscillations are negligibly small if the RF storage voltage, and hence the lower mass threshold, is sufficiently small. If the secular oscillation frequency is around 100 kilohertz, and if the frequency of the RF storage voltage is around one megahertz, the imposed oscillations have an amplitude amounting to only a few percent of the amplitude of the secular oscillation. The situation is different if the RF storage voltage is set higher in order to obtain harder collisions. If the lower mass threshold is half of the mass-to-charge ratio of the parent ions, the imposed oscillations already have an amplitude amounting to around one quarter of the amplitude of the secular oscillations. These amplitudes must be taken into account to ensure that the oscillating parent ions do not collide with the electrodes of the ion trap.

The collision-induced decomposition is normally undertaken with a high collision gas pressure which can just about be tolerated in order to achieve a high number of collisions. It is thus possible, even in ion traps which are also used as mass analyzers, to create a situation where the parent ions experience up to four collisions with the collision gas in each oscillation cycle. The collision gas is usually helium because this also allows the ion trap to be used as a mass analyzer without any loss of mass-resolving power. The pressure of the helium is then around a few tenths of a Pascal. If it is assumed that the middle ten ion oscillations fulfill the conditions for hard collisions, then the parent ions undergo around 40 hard collisions, which is sufficient for medium-mass parent ions in the physical mass range between m=500 and 1500 Daltons to undergo ergodic fragmentation. For heavier analyte ions, the number of collisions or their energy must be increased.

The energy of the collisions depends not only on the oscillation amplitude, but also especially on the oscillation frequency, since the speed of the parent ions increases with the frequency. The secular oscillation frequency of the parent ions can be increased by increasing the RF storage voltage. In this case, the forced oscillations must be taken into account to avoid loss of ions by impingement on the electrodes.

If another type of mass analyzer is used to analyze the ions, and if the RF ion trap serves only as a manipulation cell for the ions, the collision gas can also be used at a higher density, or a slightly heavier collision gas, for example nitrogen or argon, can be used. A heavier collision gas increases the energy input per collision. In ion traps which are also used as mass analyzers, the pressure of the collision gas can be increased in pulses during the fragmentation cycle. It is then even possible to introduce a collision gas with higher molecular mass in pulses.

Figure 2:
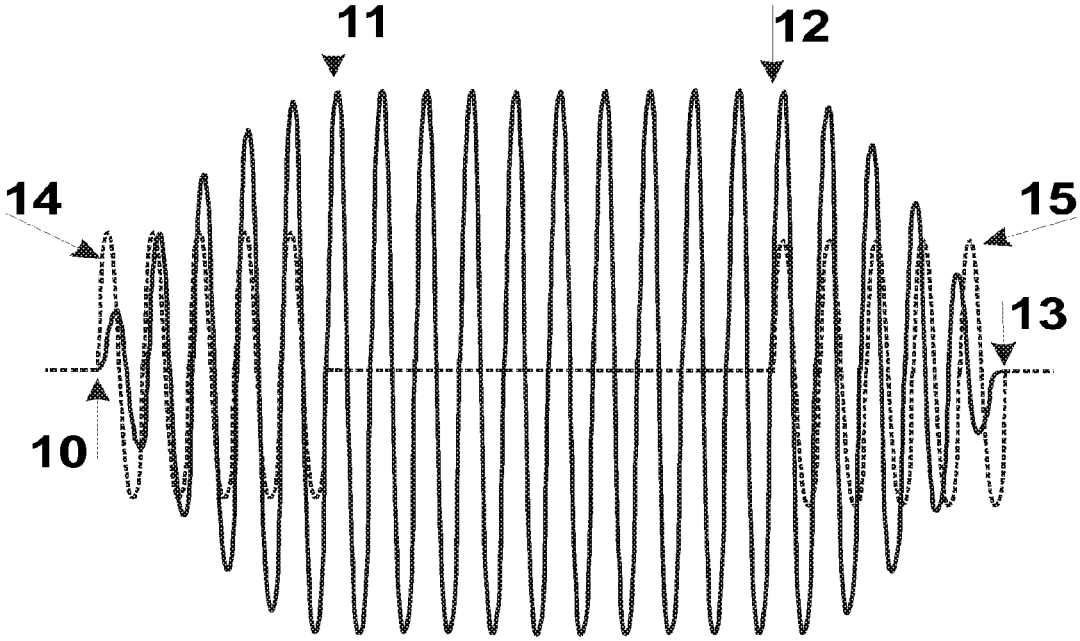
FIG. 2 represents a non-resonant excitation similar to that in FIG. 1, but with higher excitation voltage (14) and a different frequency of around 90 kilohertz, which thus produces a faster oscillation start-up between the beginning (10) of the excitation and the beat antinode (11). Between the times (11) and (12) the excitation voltage is completely switched off, producing a period of constant amplitude. The slight damping by the collision gas, and the fact that forced oscillation produced by the RF storage voltage is superimposed on the ion oscillations, are disregarded here. At time (12), a phase-adjusted excitation voltage (15) begins to decelerate the oscillation to a halt; the excitation voltage is switched off again at time (13).

A disadvantage of using a single beat antinode is that the ion oscillation maintains its maximum amplitude for only a short time. It is, however, relatively easy to achieve a longer period of oscillation with constant amplitude by switching off the excitation from time to time, as shown in FIG. 2. These oscillations then occur precisely at the secular oscillation frequency of the ions. The duration of the interruption must be a multiple of the oscillation period of the secular frequency of the ion when the phase angle of the deceleration voltage at the time of switching on again corresponds with the phase angle of the excitation voltage at the time of switching off. FIG. 2 represents a non-resonant excitation similar to that in FIG. 1, but here the excitation voltage (14) used is roughly twice as high and the frequency is also different—around 90 kilohertz. This produces a faster oscillation start-up between the beginning (10) of the excitation and the maximum amplitude being reached in the beat antinode (11). When the maximum amplitude has been attained, the excitation voltage is switched off completely, in this case between the times (11) and (12). This produces a period of constant amplitude, if the imposed forced oscillation, on the one hand, and the slight damping by the collision gas, on the other, are disregarded. This FIG. 2 does not show that forced oscillations produced by the RF storage voltage are superimposed on the secular ion oscillations. At time (12), a phase-adjusted switching on of the excitation voltage (15) begins to decelerate the oscillation to a halt; the excitation voltage is switched off again at time (13).

The maximum duration of the exposure to hard collisions is limited by the isotopy. Since it is generally of interest to see the fragment ions of all isotope compositions, the parent ions with all isotope compositions must be treated and fragmented in the same way as far as possible. The isotopy of the fragment ions can be used to determine the charge state of the ions, for example. However, since the masses of the ions composed of different isotopes are different, these ions also oscillate at different speeds and therefore cannot synchronously maintain the same secular oscillation.

A rule of thumb is that the ions of the lightest and heaviest isotope mixtures are roughly 0.2 percent apart in their mass, so that there is always a difference of around 0.1 percent between an average mass, which is excited as the target mass, and the lightest and heaviest ions of the isotope group. Since the oscillation frequencies are roughly inversely proportional to the masses, the oscillation frequencies of the lightest and heaviest ions are also around 0.1 percent away from the average oscillation frequencies. This means that after 1000 oscillations the phases of the lightest and heaviest ions have shifted by a complete period with respect to the medium-mass ions. It has been determined experimentally that the oscillations should not shift by more than one tenth of a period, at most. In other words, the number of oscillations during the exposure time may only be around 100 at maximum, regardless of whether they are excited resonantly or non-resonantly. For parent ions with a secular frequency of 100 kilohertz, the exposure time can therefore be one millisecond at maximum; for parent ions with a secular frequency of 200 kilohertz, only half a millisecond.

Figure 3:
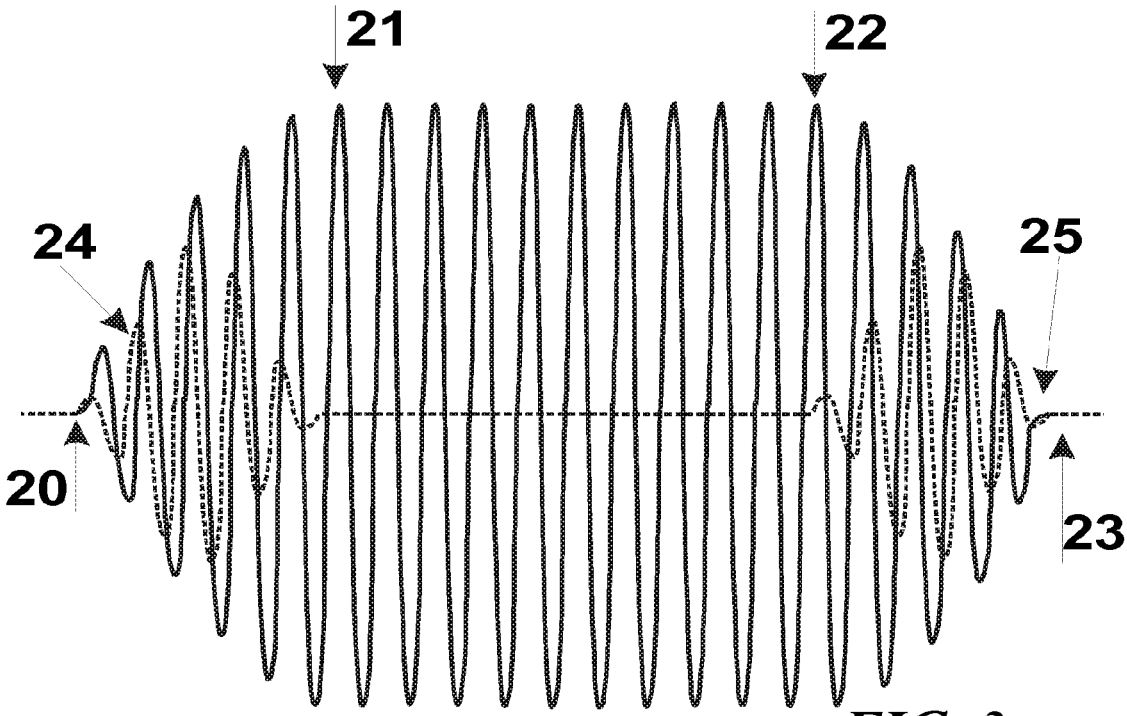
FIG. 3 illustrates that a similar beat form of the ion oscillations can also be formed with a resonant excitation and deceleration to a halt. The excitation and deceleration to a halt are done by means of two alternating voltage packets (24) and (25); here a phase rotation of 180° is used to decelerate the oscillations to a halt. If the excitation packet is examined with a Fourier analysis, it is apparent that what occurs here is a superimposition of two non-resonant oscillations which resonantly excite the parent ions in their superimposition. Alternatively, an alternating voltage packet with no phase shift can also be used for the deceleration. But then, the offset has to be a half-integer (not a whole-integer) multiple of the oscillation period of the secular frequency.

As FIG. 3 illustrates, a beat form of the ion oscillations similar to that in FIG. 2 can also be created with resonant excitation and deceleration to a halt. The excitation and deceleration to a halt are done by means of two precisely calculated alternating voltage packets (24) and (25), a phase rotated 180° being used to decelerate the oscillations to a halt. The shape of the alternating voltage packet here was formed as a superimposition of two non-resonant excitation frequencies. and thus in itself represents a beat antinode. The superimposition of two non-resonant oscillations therefore resonantly excites the parent ions. The excitation is resonant because the excited ion oscillations have exactly the frequency of the freely oscillating ions, i.e. the secular frequency, something which is not the case with non-resonant excitation.

Alternatively, an alternating voltage packet with no phase rotation can also be used for the deceleration. But the offset then has to be a half-integer (not a whole-integer) multiple of the oscillation period of the secular frequency. Incidentally, it is interesting to see that a joint Fourier analysis of the two excitation packets for excitation and deceleration to a halt never contains the secular frequency of the ions if the ions are brought completely to their resting state again by these packets. Of particular interest is the fact that a resonant excitation occurs with an excitation packet which does not even contain the secular frequency but is instead composed of two (or more) superimposed frequencies, both (or all) of which are different from the secular frequency.

In most mass spectrometers, the packets of excitation alternating voltages are calculated once as a digital sequence of numerical values and then passed to a digital-to-analog converter (DAC), numerical value by numerical value, during the execution time.

Incidentally, by superimposing four different non-resonant frequencies onto excitation voltages it is possible to generate a profile of the secular oscillations of the parent ions which roughly corresponds to the oscillation profiles of FIGS. 2 and 3, without the excitation voltage having to be switched off when the oscillation antinode is reached. This form of oscillation then has a fixed, unchangeable length.

Figure 4:
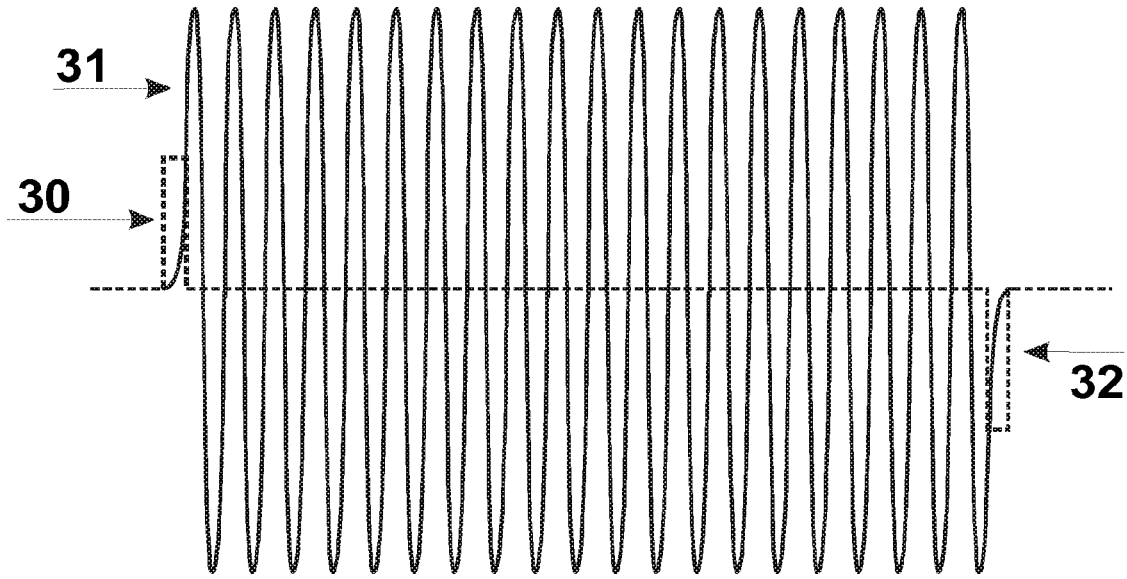
FIG. 4 shows how the secular ion oscillations (31) are excited and decelerated to a halt by two DC voltage pulses (30) and (32). The DC voltage pulse for decelerating the oscillations to a halt does not have to have the opposite polarity to the excitation pulse. It is also possible to decelerate the oscillations to a halt with a deceleration pulse of the same polarity; but then a different phase has to be selected.

In principle, no alternating excitation voltage at all is needed to excite the ion oscillations. The oscillation can also be excited with simple DC voltage pulses. FIG. 4 illustrates how the secular ion oscillations (31) are excited and decelerated to a halt by two DC voltage pulses (30) and (32). This requires quite high voltages, however. The DC voltage pulse to decelerate the oscillations to a halt here has opposite polarity; but it is also possible to decelerate the oscillations to a halt with a deceleration pulse which has the same polarity and shape as the excitation pulse; but a different phase has to be selected. The temporal width of the excitation pulses is only around one quarter of the secular oscillation cycle. This method has the slight disadvantage that the deceleration pulse strongly excites all the fragment ions formed until that point in time and, in the most unfavorable case, ejects them from the ion trap when the RF storage voltage is reduced. This is of no consequence, however, when it is preferable that the only fragment ions to be collected are those created with a delay by the ergodic decomposition after the oscillations have been decelerated to a halt.

The advantage of all the embodiments described so far is particularly that the amplitude of oscillation can be accurately aligned to the form of the ion trap so that the parent ions oscillate until shortly before the electrodes of the ion trap. This is not possible with conventional collision-induced decomposition, where an equilibrium is set up between a continuously accelerating excitation and a continuous damping by the collision gas. The damping is a statistical process and subject to strong fluctuations, so that a high safety margin has to be maintained. With this invention, it is possible to achieve extremely wide oscillations; and the associated kinetic energy of the parent ions, which increases with the square of the amplitude, means that the transfer of collision energy into the interior of the parent ions increases to such an extent that the 400 or so collisions (the maximum possible here) are quite sufficient to make the majority of the parent ions ergodically decompose.

The RF storage voltage should be reduced to a level where a lower mass threshold for the ion storage is achieved which is able to hold the light daughter ions which are to be detected.

To detect all immonium ions, the cut-off mass should then be around 55 Daltons because the lightest amino acid has a molecular mass of 57 Daltons.

There is a limit to the speed at which the RF storage voltage can be switched over because an air-core transformer is usually used to generate it and this has a specific energy content. The changeover times are usually in the order of around 100 microseconds. This is not a disadvantage here because it means a short period of time is available for damping the remaining oscillations. As has been pointed out above, not all ions of different isotope compositions can be uniformly decelerated to a halt, which means that some isotope ions still execute residual oscillations.

For heavy parent ions, in particular, with a molecular mass of between 2000 and 5000 Daltons, it can be necessary to select an unusually high RF storage voltage for the collision-induced decomposition so as to generate collisions with higher energies than are possible with the usual method. It is quite possible to select an RF storage voltage so high that the lower mass threshold for the ion storage is half to roughly two-thirds of the mass-to-charge ratio of the parent ions. Good experimental results are obtained if the cut-off mass is around half of the mass of the parent ions. It must be borne in mind that, at high RF storage voltages, the forced oscillations imposed on the oscillating ions in the pseudopotential well have relatively large amplitudes as a result of the RF field. In an RF storage field in which parent ions oscillate only slightly above the cut-off mass, the amplitudes of the imposed forced oscillations are roughly as big as the amplitudes of the secular oscillations in the pseudopotential well. The imposed forced oscillations have very high energy and assist with the fragmentation.

Figure 5:
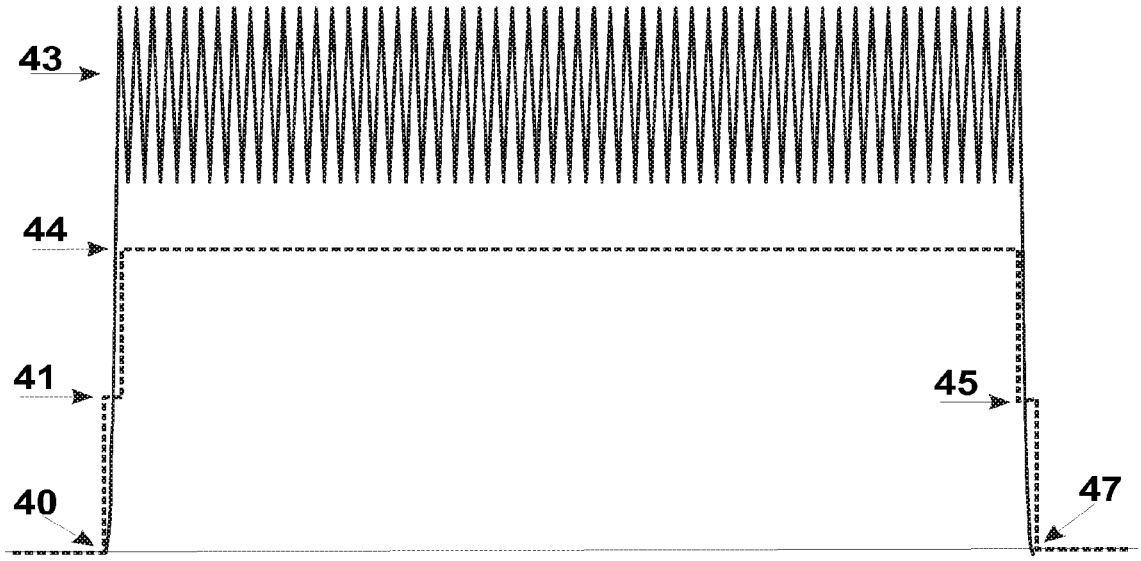
FIG. 5 shows a totally different embodiment of the invention. The exposure for hard collisions is different here; the hard collisions only occur as a result of forced, imposed oscillations (43) of the RF storage voltage, while a DC voltage (44) between opposing electrodes brings the ions from the center into a region in which the RF storage voltage has a high field. At the beginning (40), an initial DC voltage (41) is switched on, which accelerates the ions out of the center and catapults them far from the center. When the parent ions have arrived at the desired position, the DC voltage is increased until it has attained its retention voltage (44). The parent ions now execute the forced oscillations (43). After a sufficiently long exposure, the process is run through backwards (45, 47). In principle, the exposure here can run for any length of time because the forced oscillation is the same for the ions of all isotope compositions. The in-phase temporal positioning of the two DC voltage stages (41) and (44) means that the deflection does not excite the ions to strong oscillations around the desired position of the deflection. This prevents ions being lost at the electrodes even with large deflections.

A further embodiment subjects the parent ions to only these forced oscillations at a point with a high RF storage field. The process is shown in FIG. 5. No alternating excitation voltage is used; instead, a DC voltage (41) is simply applied to the ion trap electrodes, causing the cloud of parent ions to be catapulted almost to one of the electrodes. Here they are subjected to the forced oscillations (43). The imposed forced oscillations (43) lead to large numbers of high energy collisions with the collision gas. The DC voltage is now increased to the value (44) to hold the parent ions there. Switching the two DC voltages (41) and (44) at a precise time means that the deflection does not excite the ions to strong oscillations around the desired position of the deflection. This prevents ions being lost at the electrodes, even with large deflections. After an exposure time, the retention voltage is reduced to the value (45), catapulting the parent ions into the center of the ion trap. When they have arrived there, the DC voltage is completely switched off (47). This method can also be modified. It is thus possible to apply potentials of opposite polarity to two opposing electrodes or to use only one potential asymmetrically.

Since all parent ions, including those of different isotope compositions, are subjected to the forced oscillation in a very similar way, the parent ions can, in principle, be subjected to these collisions for any length of time without an isotope discrimination occurring. However, a long exposure is unfavorable here because all fragment ions whose mass-to-charge ratio is heavier than that of the parent ions are pushed against the electrodes by the DC voltage and thus destroyed. Lighter fragment ions are likewise subjected to forced oscillations, although not as strongly; they can be fragmented further, however. When multiply charged ions are fragmented, large numbers of fragment ions are always formed whose mass-to-charge ratio is heavier than that of the parent ions. Reducing the DC voltage is designed to take into account the phase of the forced oscillations imposed on the parent ions, since their amplitudes and kinetic energies can no longer be ignored.

Figure 8A:
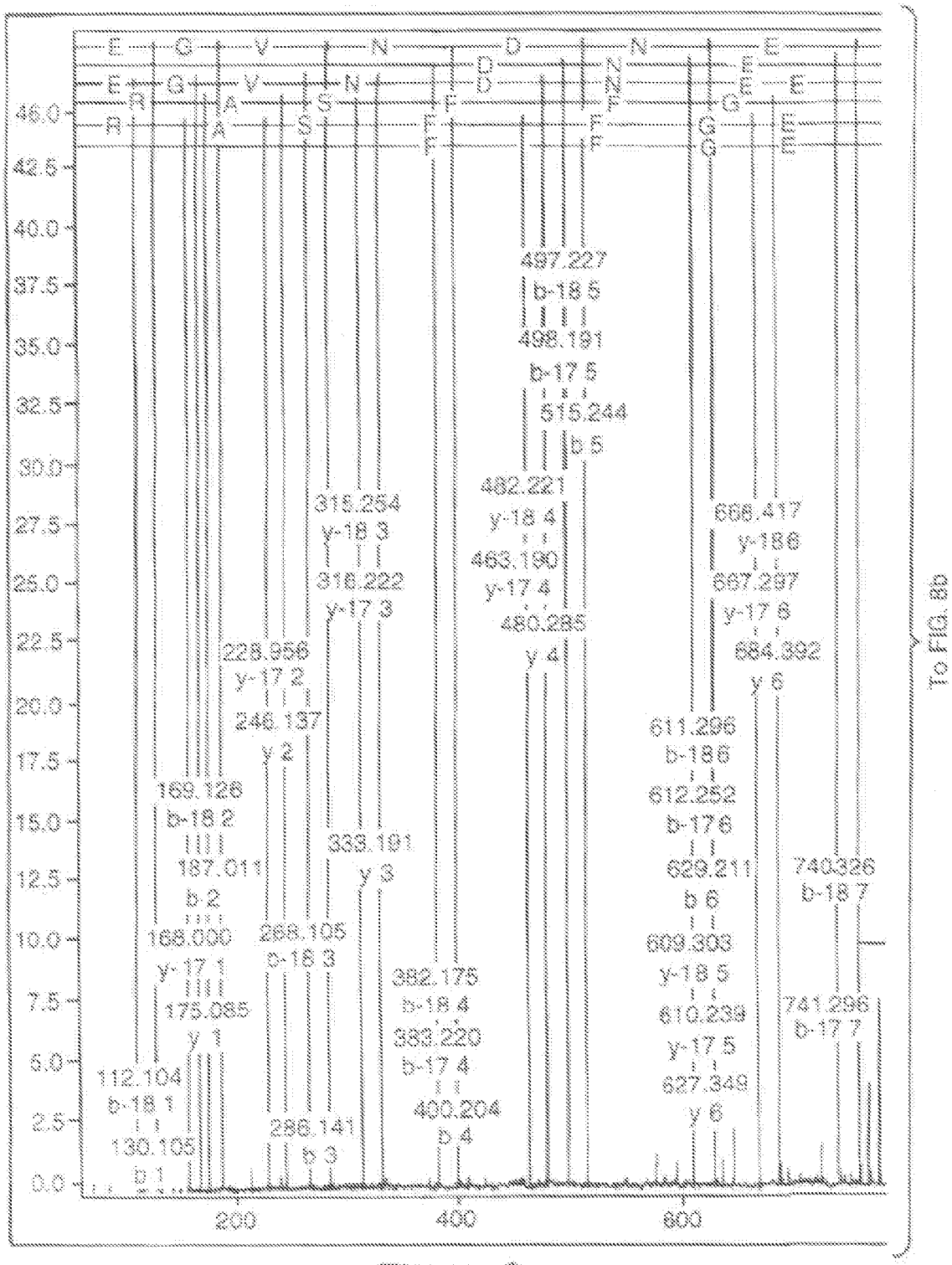
FIG. 8 illustrates a mass spectrum of the fragment ions of doubly charged ions of a peptide called Glu-Fib, which has a molecular mass m=1569.7 Daltons and whose ions were fragmented using the method according to this invention. The sequence of the b, (b-17), (b-18), y, (y-17) and (y-18) ions was automatically annotated by an identification program. The mass spectrum extends as low as the mass-to-charge ratio m/z=80.
Figure 8B:
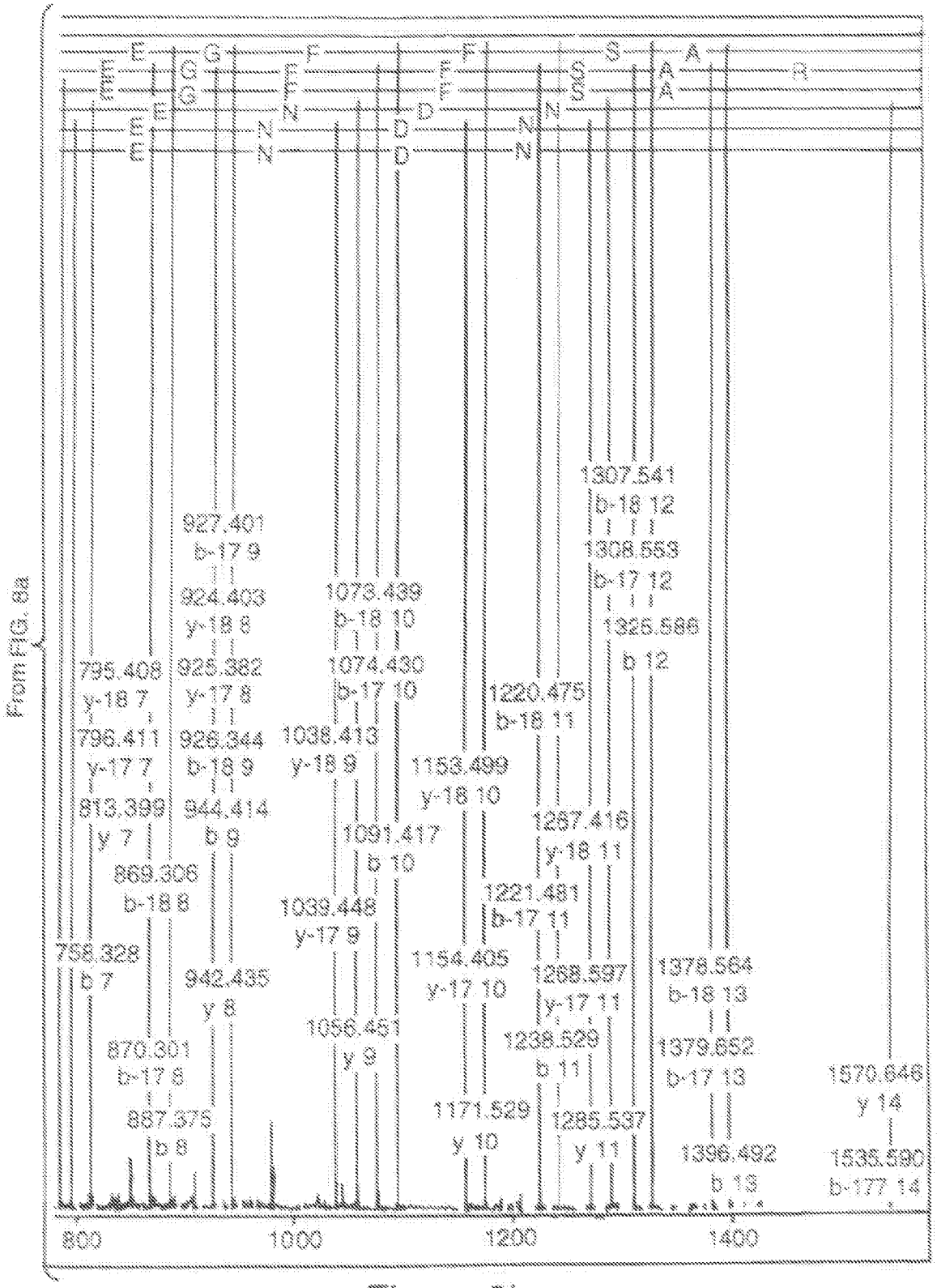

The collision-induced decompositions according to this invention also have the surprising advantage that the fragmentation can be undertaken at moderately high RF storage voltages if the mass of the parent ions is not very high. It is quite possible to achieve very good fragmentations with a setting at which the lower mass threshold is one sixth of the mass-to-charge ratio of the parent ions. FIG. 8 shows a fragment ion spectrum of Glu-Fib scanned under these conditions. Glu-Fib has a molecular mass of m=1569.7 Daltons; fragmentation takes place here in the doubly charged state. A large number of fragment ions are collected even during the exposure time, and only the very light fragment ions, for example the immonium ions, are added after the RF storage voltage has been reduced.

The question is, when exactly the immonium ions are created. Since they are generally internal fragment ions, i.e. they originate from ergodic secondary decompositions, their decomposition time is presumably quite long, and they can still successfully be collected even after a millisecond has passed.

Very heavy analyte ions with molecular masses between 2000 and 5000 Daltons, for example, are usually highly charged. If they have been ionized in electrospray ion sources, they have 4 to 10 protons. Their mass-to-charge ratios are between 500 and 1200 Daltons. The fragment ion spectra of these highly charged analyte ions are extraordinarily complicated and almost impossible to analyze. It is therefore advisable to first partially deprotonate them before they are fragmented.

The deprotonation is done using reactions of the highly charged analyte ions with suitable reactant anions. The reactant anions are generally non-radical anions; many different substance classes can be used to form these reactant anions. A deprotonation reaction consists in a proton transfer from a highly charged analyte ion to a reactant anion, the latter being neutralized without forming a radical in the process. The deprotonation reactions have reaction cross-sections proportional to the square of the charge level of the highly charged analyte ions; the reactions for highly charged analyte ions proceed exceedingly quickly.

The deprotonation can be halted at a preselected charge level. The deprotonation in the RF ion trap is halted by applying a dipole alternating voltage to produce weak resonant excitation of the analyte ions which have reached this charge level as a result of continued deprotonation. The excitation must not be so strong as to eject the analyte ions from the ion trap. An equilibrium must be set up between the excitation brought about by the dipole alternating voltage and the damping by the collision gas. This type of weak excitation is familiar with ion traps (for collision-induced decomposition, for example) and can be carried out by the software control of any commercially available ion trap. The motion of the analyte ions as they execute their secular oscillation removes them from further deprotonation reactions because these only occur at low relative speeds.

This method thus allows all analyte ions with higher charge levels to be deprotonated to a desired charge level. This makes the mass spectra of the fragment ions much easier to interpret.

Figure 10:
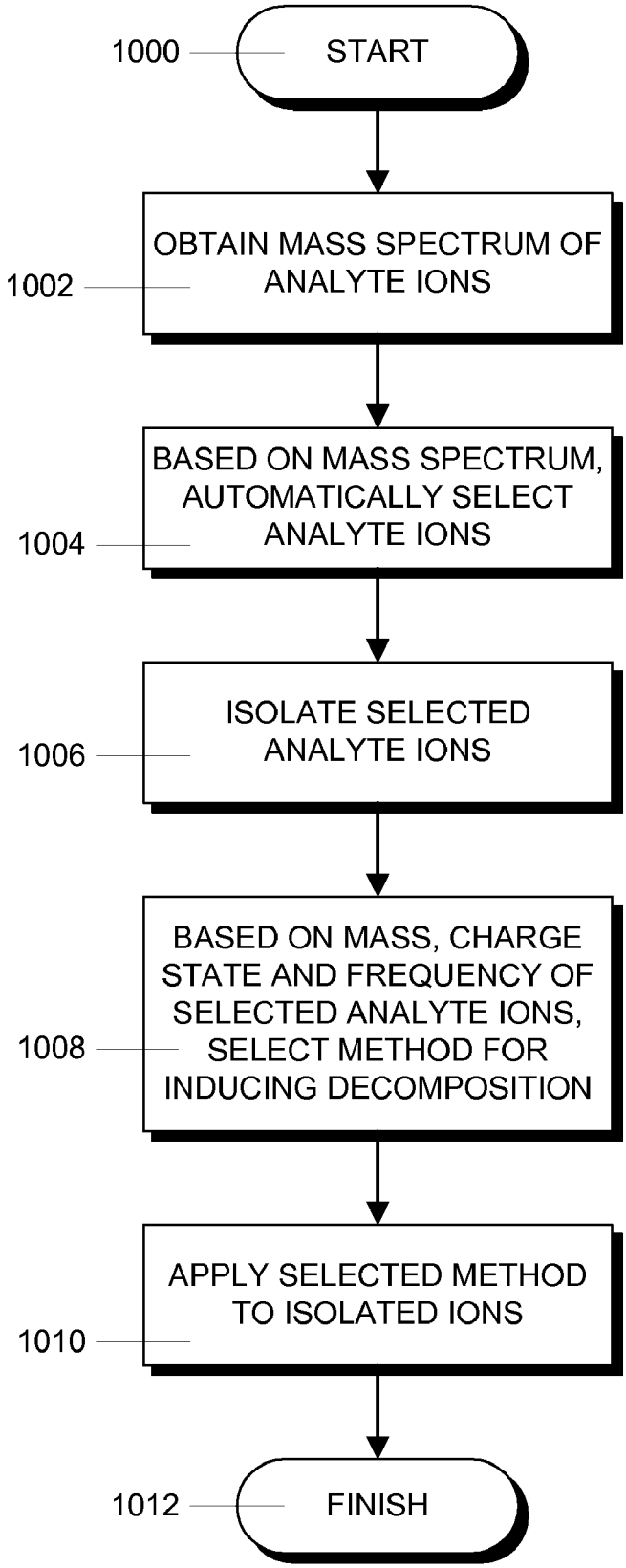
FIG. 10 is a flowchart showing the steps in a process for automatically selecting a method for decomposing analyte ions in an RF ion trap based on selected characteristics of the analyte ions.

Fragmentations frequently have to be carried out on analyte ions which are only briefly available for mass spectrometric analysis, for example if they originate from an upstream separation process, i.e. from a liquid chromatograph or a capillary electrophoresis device. Then, automated analytical methods are generally employed which also incorporate an automatic fragmentation of the analyte ions. An example of such an automated process is shown in FIG. 10. This process begins in step 1000 and proceeds to step 1002 where a scan of a quite normal mass spectrum is obtained. In step 1004, this mass spectrum is used to automatically determine which analyte ions are to be subjected to fragmentation, so that the fragment ion spectra can be scanned. Next, in step 1006, the selected analyte ions are isolated in the ion trap and, in step 1008, based on the mass, charge state and frequency of the selected analyte ions, a method for inducing decomposition of the isolated analyte ions is chosen. Finally, in step 1010, the selected method is used to decompose the isolated analyte ions. The process then finishes in step 1012.

In these automated analytical methods, the type of collision-induced decomposition can automatically be determined by the mass, charge state and frequency of the particular analyte ions being analyzed. The mass, charge state and frequency determine whether conventional collision-induced decomposition by excitation-damping equilibrium, collision-induced decomposition by brief excitation with damping and reduction of the RF storage voltage, nonresonant excitation/deceleration to a halt, resonant excitation/deceleration to a halt or pulsed excitation/deceleration to a halt is automatically carried out, the latter three with or without sudden reduction of the RF storage voltage in each case. Moreover, it is also possible, depending on the mass and charge state, to determine whether the collision-induced decomposition should be preceded by a deprotonation.

Figure 6:
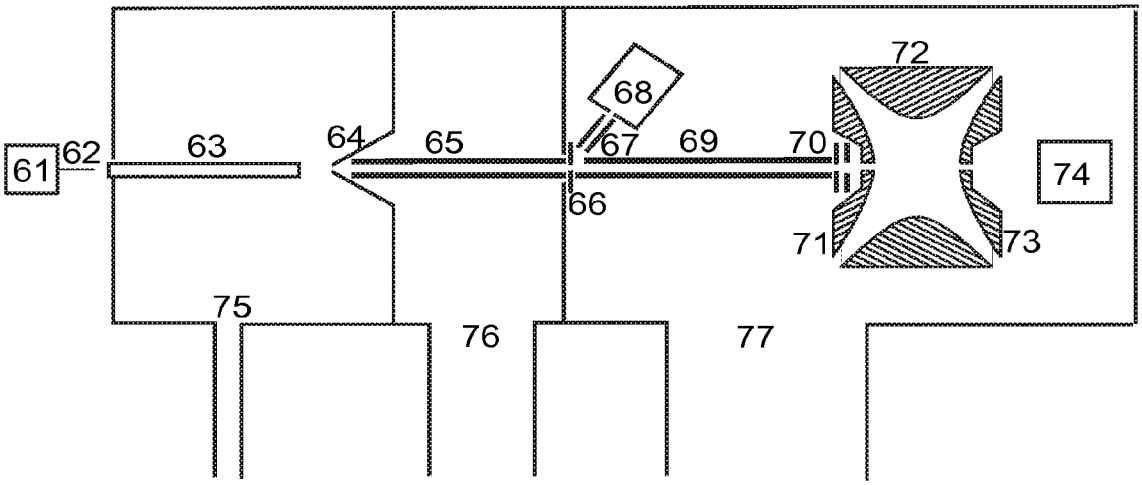
FIG. 6 is a schematic representation of a 3D ion trap mass spectrometer for carrying out a method according to this invention; here it comprises an electrospray ion source (61, 62), an electron attachment ion source (68) to generate negative ions for the deprotonation, and a 3D ion trap with end cap electrodes (71, 73) and ring electrode (72). The ion guide (69), which takes the form of an octopole rod system here, can guide both positive and negative ions to the ion trap. The excitation voltages are fed to the two end cap electrodes (71, 73).

A favorable embodiment of an ion trap mass spectrometer to carry out methods according to this invention is shown schematically in FIG. 6. Here, an electrospray ion source (61) with a spray capillary (62) is used outside the mass spectrometer to ionize the analyte molecules. The analyte molecules are in an aqueous solution, to which organic solvents such as methanol or acetonitrile are admixed to make the spraying easier. The analyte ions generated by the electrospray ionization, some of which are highly charged, are guided in the usual way through an inlet capillary (63) and a gas skimmer (64) into the ion guide (65), the entrained ambient gas being largely removed by suction. With the help of the ion guides (65) and (69), the charged analyte ions are guided through the pressure stages (75), (76), (77) to the 3D ion trap with end cap electrodes (71) and (73) and ring electrode (72), where they are captured in the usual way. The ion guides (65) and (69) comprise parallel rod pairs, across which the phases of an RF voltage are alternately applied. They usually take the form of a hexapole or octopole rod system.

A first mass spectrum, obtained by resonant excitation of the ions with mass-selective ejection and with measurement in the ion detector (74), provides an overview of the various charge levels at which the analyte ions are present. After the ion trap has been refilled, the ionic species of a selected charge level can now be isolated by the usual means; these ions then form the parent ions for the fragmentation. For this purpose, the ion trap is initially overfilled so that there will subsequently be enough ions remaining for a good scan, and then all ions which do not correspond to the parent ions selected are ejected from the ion trap.

A short delay of a few milliseconds causes the collision gas present to damp the analyte ions into the center of the trap. There they form a small cloud around one millimeter in diameter. The parent ions are then fragmented, and this can be done using one of the methods according to the invention. They can also be fragmented by electron transfer dissociation, for example, in which case the radical anions required can be generated in the ion source (68). It is also possible to use other types of fragmentations, however.

If the analyte ions are highly charged, they can be partially deprotonated, before being fragmented, by adding non-radical negative ions. The non-radical anions for the deprotonation can be generated in the ion source (68). They can also be generated in the electrospray ion source (61), usually by using a second spray capillary (62). The non-radical anions here can be generated by a corona discharge in the entrance region of the inlet capillary (63).

The negative ions from the ion source (68) for negative chemical ionization can be guided via a small ion guide (67) to an ion selector, where they are inserted into the ion guide (69) to the ion trap (71, 72, 73). In the embodiment shown here, the ion selector simply comprises an apertured diaphragm (66) and a shortening of two rods of the rod-shaped ion guide (69). It is particularly favorable for this very simple type of ion selector if the ion guide is implemented as an octopole system.

Figure 7:
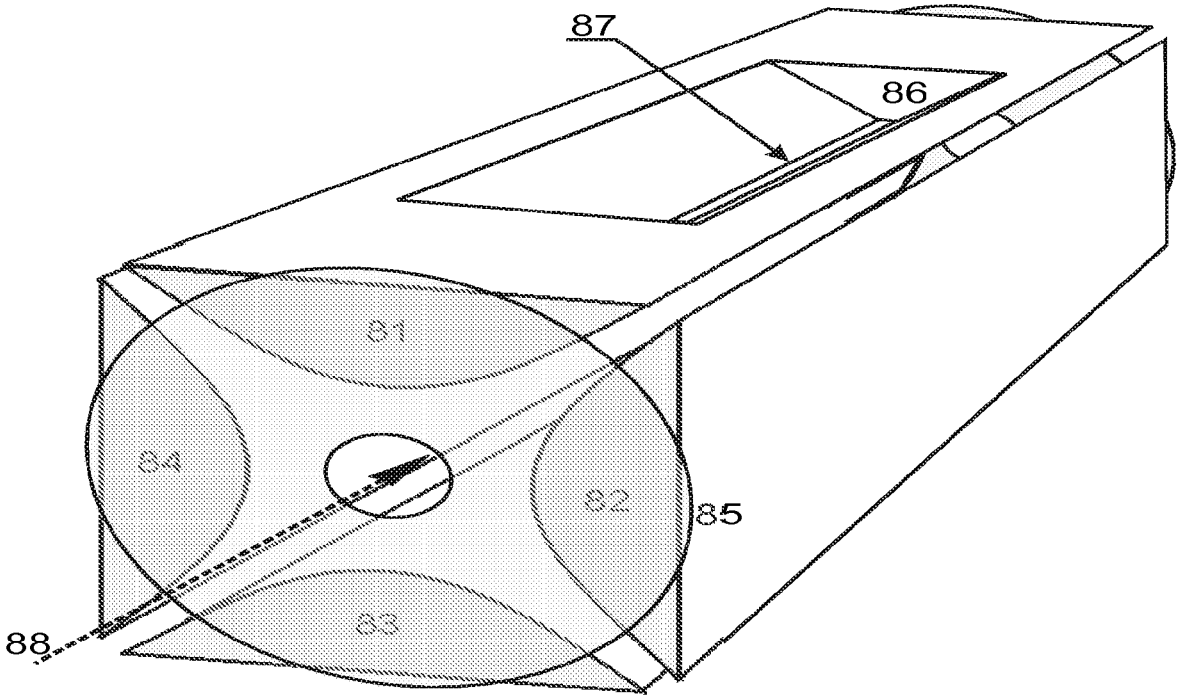
FIG. 7 illustrates schematically a 2D ion trap mass spectrometer in which the ion trap comprises four hyperbolic pole rods (81-84), with pole rod (81) being equipped with a slit (87) to eject the ions. The excitation voltages here are fed to two opposing pole rods, for example to the pole rods (81) and (83). By applying an additional alternating voltage across the other two pole rods, out of phase by 90°, it is possible to excite a circular oscillation instead of the linear oscillation.

Finally, FIG. 7 shows a linear ion trap which can be used instead of a 3D ion trap. Here, the alternating voltage to excite the parent ions for the fragmentation can be connected to two opposing pole rods, for example the pole rods (81) and (83). The alternating voltage can be superimposed on the RF storage voltage prevailing there; but it is also possible to connect the RF storage voltage to only two pole rods. The linear ion trap is terminated by apertured diaphragms (85), through which the ions (88) can be introduced. The linear ion trap can also be used as a mass analyzer by ejecting the ions by resonant excitation through a slit (87) at the bottom of a cutout 86 in the pole rod (81) toward an ion detector (not shown).

By using two alternating voltages which are out of phase by 90° and are applied crosswise to the four pole rods of the linear ion trap, it is possible to excite a circular oscillation instead of the linear oscillation. This form of excitation has the particular advantage that it minimizes the interaction of the excited ions with non-excited ions, which remain in the center of the ion trap. This improves the selectivity of the excitation. This method of excitation is particularly efficient when it is used to halt the above-described deprotonation at a specific charge state.

In linear ion traps, the alternating voltages used for the excitation can also be applied across auxiliary electrodes arranged in the spaces between the pole rods.

A person skilled in the art can easily implement at least some of the fragmentation methods according to this invention. Commercial ion trap mass spectrometers generally only require a different form of control; all the necessary voltage generators are generally present, although for some of the suggested methods the voltages available may not be high enough. The control can be changed by adapting the software. In some commercial ion trap mass spectrometers, it is even possible, depending on the state of the software, for the user to undertake the changes to the control procedures himself.

What is claimed is:

1. A method for collision-induced decomposition of analyte ions in an RF ion trap having an RF storage voltage applied thereto and being filled with a collision gas, comprising:

(a) setting the RF storage voltage to a value such that a lower mass threshold of the ion trap is greater than one eighth and less than one half of the mass-to-charge ratio of the analyte ions;

(b) exciting oscillations of the analyte ions by means of an electric field, in order to produce hard collisions with the collision gas; and (c) decelerating the oscillations to a halt by means of an electric field in order to assemble collisionally excited analyte ions in a center location of the ion trap.

2. The method of claim 1, wherein after step (c), the RF storage voltage is reduced so that light fragment ions produced by ergodic decompositions of the collisionally excited analyte ions occurring after step (c) can also be stored in the ion trap.

3. The method of claim 1, wherein the oscillations are excited in step (b) and decelerated to a halt in step (c) by resonant or non-resonant alternating excitation fields.

4. The method of claim 3, wherein the alternating excitation fields are switched off for a predetermined exposure time between step (b) and step (c).

5. The method of claim 1, wherein the oscillations are excited in step (b) by the field of a first DC voltage pulse and decelerated to a halt at step (c) by the field of a second DC voltage pulse, and wherein there is a predetermined exposure time between the first and the second DC voltage pulses.

6. The method of claim 1, wherein step (b) comprises switching on an electric DC field with sufficient strength to force the analyte ions into an ion trap region with a strong RF storage field and to keep the analyte ions in that region, and wherein step (c) comprises switching off the electric DC field.

7. The method of claim 1, further comprising, before step (a), partially deprotonating the analyte ions when the analyte ions are highly charged.

8. The method of claim 7, wherein the partial deprotonation is halted when the analyte ions reach a predetermined charge level.

9. The method of claim 1, wherein step (b) comprises increasing a pressure of the collision gas to enhance collision-induced decomposition.

10. The method of claim 1, wherein the method further comprises after step (c), at least partially removing remaining undecomposed analyte ions from the ion trap by resonant excitation.

* * * * *